US009766002B2

(12) United States Patent
Bernhardt et al.

(10) Patent No.: US 9,766,002 B2
(45) Date of Patent: Sep. 19, 2017

(54) REFRIGERATION METHOD AND INSTALLATION USING PARALLEL REFRIGERATORS/LIQUEFIERS

(75) Inventors: Jean-Marc Bernhardt, La Buisse (FR); Cindy Deschildre, Sassenage (FR); Eric Fauve, Venelles (FR); David Grillot, Rives (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 504 days.

(21) Appl. No.: 14/346,610

(22) PCT Filed: Aug. 14, 2012

(86) PCT No.: PCT/FR2012/051896

§ 371 (c)(1),
(2), (4) Date: Mar. 21, 2014

(87) PCT Pub. No.: WO2013/041790

PCT Pub. Date: Mar. 28, 2013

(65) Prior Publication Data

US 2014/0238070 A1 Aug. 28, 2014

(30) Foreign Application Priority Data

Sep. 23, 2011 (FR) ..... 11 58478
Nov. 24, 2011 (FR) ..... 11 60744

(51) Int. Cl.
*F25B 1/10* (2006.01)
*F25B 43/02* (2006.01)
(Continued)

(52) U.S. Cl.
CPC ..... *F25B 43/02* (2013.01); *F25B 1/10* (2013.01); *F25B 5/02* (2013.01); *F25B 9/002* (2013.01);
(Continued)

(58) Field of Classification Search
CPC .. F25B 43/02; F25B 5/02; F25J 1/0065; F25J 1/0272; F25J 5/00; F25J 2230/20;
(Continued)

(56) References Cited

U.S. PATENT DOCUMENTS 4,267,701 A 5/1981 Toscano
6,898,949 B2 * 5/2005 Paradowski ..... F25J 1/0022 62/613

(Continued)

FOREIGN PATENT DOCUMENTS

FR 2 919 716 2/2009

OTHER PUBLICATIONS

International Search Report for PCT/FR2012/051896, mailed Feb. 14, 2013.

*Primary Examiner* — David Teitelbaum
(74) *Attorney, Agent, or Firm* — Christopher J. Cronin

(57) ABSTRACT

An installation for refrigerating a same application by means of a single refrigerator/liquefier or several refrigerators/liquefiers arranged in parallel, the refrigerator(s)/liquefier(s) using a working gas of the same type having a low molar mass, each refrigerator/liquefier comprising a compression station to compress the working gas, a cold box intended for cooling the working gas at the outlet of the compression station, the compression station comprising only compression machines of the lubricated screw type and systems for removing the oil from the working fluid at the outlet of the compression machines, and the compression station comprises a plurality of compression machines defining several levels of pressure for the working fluid, the compression station comprising at least two compression machines defining at least two levels of pressure increasing above the level of pressure of the fluid at the inlet of the compression station, two main compression machines being arranged in series and defining, at their respective fluid outlet, levels of pres-
(Continued)

sure respectively called "low" and "high", another secondary compression machine being supplied at the inlet with a fluid coming from the cold boxes at an intermediate level of pressure called "medium" between the low and high levels, this secondary compression machine also defining, at its fluid outlet, a "high" level of pressure.

7 Claims, 2 Drawing Sheets

(51) Int. Cl.

| | |
|---|---|
| ***F25B 5/02*** | (2006.01) |
| ***F25B 9/00*** | (2006.01) |
| ***F25J 1/00*** | (2006.01) |
| *F25J 1/02* | (2006.01) |
| *F25J 5/00* | (2006.01) |

(52) U.S. Cl.
CPC ..... *F25J 1/0065* (2013.01); *F25J 1/0265* (2013.01); *F25J 1/0272* (2013.01); *F25J 1/0279* (2013.01); *F25J 1/0294* (2013.01); *F25J 1/0201* (2013.01); *F25J 1/027* (2013.01); *F25J 1/0271* (2013.01); *F25J 5/00* (2013.01); *F25J 2230/20* (2013.01); *F25J 2230/24* (2013.01); *F25J 2270/912* (2013.01)

(58) Field of Classification Search
CPC ..... F25J 2230/24; F25J 1/0201; F25J 1/027; F25J 1/0271
See application file for complete search history.

(56) References Cited

U.S. PATENT DOCUMENTS

| | | | | |
|---|---|---|---|---|
| 7,278,280 | B1 | 10/2007 | Ganni | |
| 2003/0089125 | A1* | 5/2003 | Fredheim | F25J 1/0022 62/612 |
| 2006/0168976 | A1 | 8/2006 | Flynn et al. | |
| 2009/0314030 | A1* | 12/2009 | Jager | F25J 1/0218 62/612 |

* cited by examiner

REFRIGERATION METHOD AND INSTALLATION USING PARALLEL REFRIGERATORS/LIQUEFIERS

CROSS-REFERENCE TO RELATED APPLICATIONS

This application is a §371 of International PCT Application PCT/FR2012/051896, filed Aug. 14, 2012, which claims §119(a) foreign priority to French patent application 1158478, filed Sep. 23, 2011 and French patent application 1160744, filed Nov. 24, 2011.

BACKGROUND

Field of the Invention

The present invention concerns a refrigeration installation and method.

The invention concerns in particular a low-temperature refrigeration installation and method wherein a gas with a low molar mass (for example hydrogen or helium) is used as a refrigerating fluid in order to attain very low refrigeration temperatures (for example 4.5 K for helium). Obtaining refrigeration at temperatures of 30 K and lower generally requires the use of a refrigerant such as helium. The helium is compressed at a hot end of the loop or circuit, and then cooled and expanded in the cold part of the loop (cold box). The major part of the refrigerant is heated by exchange and recycled in the compression stage. In some applications, part of the working gas may be liquefied.

Related Art

The compression of the helium liquefaction/refrigeration cycles generally uses one or more stages of compression machines (compressors) with lubricated screws followed by an oil-separation system.

If it is necessary to have several refrigerators, each refrigerator is connected to its own compression station. According to the rates required, each compression level may be divided into several compressors in parallel. The primary oil-management and cooling systems may be common to several compressors or be dedicated to each one.

After the compression and oil separation thereof the low molecular mass gas is cooled and expanded in cryogenic expansion turbines of a cold box in order to attain the required temperature level. The cold not used by the user of the refrigerator/liquefier is then transmitted to the working fluid at high pressure in order to cool it in the heat exchangers. The working gas at low and medium pressure of the circuit returns to the intake of the compressors.

For large refrigeration systems, for example greater than 20 kW, equivalent to 4.5 K, it is necessary to use several separate refrigerators in parallel connected to the same application to be cooled. The fluctuating thermal loads of the application to be cooled cause fluctuations in output on the compressors of the compression station. The costs of the compression station (equipment, integration and installation) are relatively high compared with the total cost of the installation.

The refrigeration cycles (which generate the cold) are conventionally "closed" at each refrigerator. That is to say the cycle output of working fluid that enters the cold box stems mainly from this same cold box. On the other hand, these cycle outputs are "open" or combined at the application to be cooled (the working fluid output supplied by the refrigerators is shared for the application to be cooled and then returns to each refrigerator through a respective distribution system).

SUMMARY OF THE INVENTION

One aim of the invention is to propose a refrigeration method and installation of an application by means of several refrigerators/liquefiers disposed in parallel that solve all or some of the above problems. In particular, one aim of the invention may be to propose a refrigeration method and installation that are less expensive and/or more compact and/or more effective and/or more flexible in use than the known systems.

To this end, the refrigeration installation of the same application comprises several refrigerators/liquefiers disposed in parallel, the refrigerators/liquefiers in parallel using a working gas of the same nature having a low molar mass, that is to say having a mean total molar mass of less than 10 g/mol such as pure gaseous helium, each refrigerator/liquefier comprising a station for compressing the working gas, a cold box intended to cool the working gas at the output from the compression station, the working gas cooled by each of the respective cold boxes of the refrigerators/liquefiers being put in thermal exchange with the application with a view to supplying cold to the latter, wherein a single compression station compresses the working gas for each of the respective separate cold boxes of the refrigerator/liquefiers disposed in parallel, the single compression station comprising only compression machines of the lubricated-screw type and systems for removing oil from the working fluid output from the compression machines, so that the compression machines and the oil-removal systems are shared by the refrigerators/liquefiers disposed in parallel.

Moreover, embodiments of the invention may comprise one or more of the following features:

- the single compression station comprises a plurality of compression machines defining several pressure levels for the working fluid,
- the passage from one pressure level to the following higher pressure level is achieved via one or more compression machines in series or via several compression machines disposed in parallel,
- the passage from at least one pressure level to the following higher pressure level is achieved via two compression machines disposed in parallel, an oil-removal system being disposed at the discharge from the two compression machines, the oil-removal system comprising either a single oil-removal member common to the two compression machines disposed in parallel, or two oil-removal members allocated respectively to the two compression machines disposed in parallel,
- the installation comprises at least one final oil-removal system disposed at the discharge from the last compression level, that is to say before a fluid connection supplying the cold box with fluid,
- the installation comprises at least one exchanger for cooling the working fluid downstream of a compression machine,
- the installation comprises three compression machines defining three increasing pressure levels above the pressure level of the fluid at the inlet of the compression station, first and second compression machines being disposed in series and defining at their respective fluid outlet pressure levels respectively said to be "low" and "high", a third compression machine being supplied at its inlet with fluid issuing from the cold boxes at a so-called "medium" pressure level intermediate between the low and high levels, the third compression machine defining at its fluid outlet also a "high" pressure level, the installation comprises a fourth compression machine disposed in parallel with the second compression machine, the outlet of the fourth compression machine being connected to the inlet of the third compression machine, the outlets of the third compression machine and of the second compression machine are connected to a common point defining the same high pressure level, the outlet of the third compression machine and the outlet of the second compression machine are connected to at least one cold box at separate locations defining respective and separate high pressure levels for the fluid.

Another aim of the invention is to propose a refrigeration installation for the same application by means of a single refrigerator/liquefier or several refrigerators/liquefiers disposed in parallel, the refrigerator(s)/liquefier(s) using a working gas of the same nature having a low molar mass, that is to say having a mean total molar mass of less than 10 g/mol such as pure gaseous helium, each refrigerator/liquefier comprising a station for compressing the working gas, a cold box intended to cool the working gas discharged from the compression station, the working gas cooled by each of the respective cold boxes of the refrigerators/liquefiers being put in heat exchange with the application with a view to supplying cold to the latter, wherein a single compression station provides the compression of the working gas for each of the cold boxes of the refrigerator(s)/liquefier(s), the compression station comprising only compression machines of the lubricated-screw type and systems for removing oil from the working fluid discharged from the compression machines, and in that the compression station comprises a plurality of compression machines defining several pressure levels for the working fluid, the passage from one pressure level to the following higher pressure level is achieved via one or more compression machines in series or via several compression machines disposed in parallel, the compression station comprising at least two compression machines defining at least two increasing pressure levels above the pressure level of the fluid at the inlet of the compression station, two main compression machines being disposed in series and defining at their respective fluid outlets pressure levels respectively said to be "low" and "high", another secondary compression machine being supplied at its inlet with fluid issuing from the cold boxes at a so-called "medium" pressure level intermediate between the low and high pressure levels, this secondary compression machine defining at its fluid outlet also a "high" pressure level.

According to other possible particularities the outlets of the secondary compression machine and of the main compression machine are connected to a common pipe defining the same high pressure level, the outlets of the secondary compression machine and of the main compression machine are connected to at least one cold box at separate locations defining respective separate high pressure levels for the fluid.

The invention also concerns a method for refrigerating the same application by means of a refrigeration and/or liquefaction installation comprising several refrigerators/liquefiers disposed in parallel, the refrigerators/liquefiers in parallel using a working gas of the same nature having a low molar mass, that is to say having a mean total molar mass of less than 10 g/mol such as pure gaseous helium, each refrigerator/liquefier comprising a station for compressing the working gas, a respective cold box intended to cool the working gas discharged from the compression station, the working gas cooled by the respective cold boxes of the refrigerators/liquefiers being put in heat exchange with the application with a view to supplying cold to it, wherein a single compression station compresses the working gas for each separate cold box of the refrigerators/liquefiers disposed in parallel, the single compression station comprising solely compression machines of the lubricated-screw type and systems for removing oil from the working fluid discharged from the compression machines, so that the compression machines and the oil-removal systems are shared by the refrigerators/liquefiers disposed in parallel.

According to other possible particularities:

when the thermal load of the application to be cooled varies, the power variations of the installation are achieved by varying the regime of only some of the compression machines of the common compression station, the application cooled by the refrigerators/liquefiers in parallel is disposed in the same chamber and comprises superconductor elements be cooled.

BRIEF DESCRIPTION OF THE FIGURES

The invention may also concern any alternative device or method comprising any combination of the above or following features.

Other particularities and advantages will emerge from a reading of the following description given with reference to the figures, wherein.

DETAILED DESCRIPTION OF THE INVENTION

Figure 1:
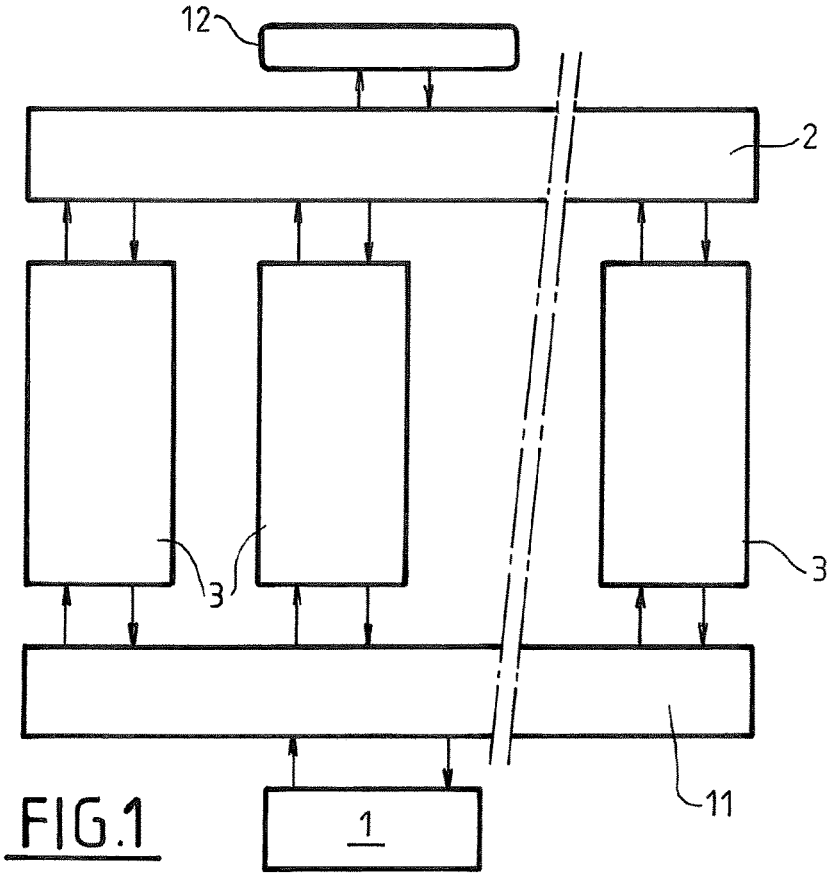
FIG. 1 shows in a simplified fashion the structure and functioning of an installation according to the invention.

The refrigeration installation shown schematically in FIG. 1 comprises several refrigerators/liquefiers (L/R) disposed in parallel, which cool the same physical entity (that is to say the same application 1).

The refrigerators/liquefiers (L/R) disposed in parallel use a working gas of the same nature having a low molar mass, that is to say having a mean total molar mass of less than 10 g/mol such as pure gaseous helium for example.

Each refrigerator/liquefier (L/R) uses a station 2 for compressing the working gas and a cold box 3 intended to cool the working gas output from the compression station 2. The working gas cooled by each of the respective cold boxes 3 of the refrigerators/liquefiers (L, R) is put in heat exchange, via a distribution circuit 11, with the application 1 with a view to supplying cold to the latter.

According to an advantageous particularity, a single compression station 2 compresses the working gas for each of the separate respective cold boxes 3 of the refrigerators/liquefiers L/R disposed in parallel.

The compression station 2 may where applicable be connected to a so-called "hot" buffer 12 for storing working fluid. According to another advantageous particularity, the single compression station 2 comprises compression machines solely of the lubricated-screw type and systems for removing oil from the working fluid at the discharge from the compression machines. In this way, the compression machines (lubricated-screw compressors) and the oil-removal systems are shared by the refrigerators/liquefiers disposed in parallel.

This configuration makes it possible to limit the number of machines and items of equipment necessary for compressing the working fluid.

This also makes it possible to concentrate the variations in load over a limited number of compressors with suitable regulation means (for example frequency variators, regulator valves, etc.).

In addition, this also where applicable makes it possible to group the compression stations by type of compressor or by function (refrigeration cycle and/or customer supply) rather than by refrigeration cycles.

The architecture also where applicable makes it possible to provide several fluid cycle pressures per function or per compression station.

Figure 2:
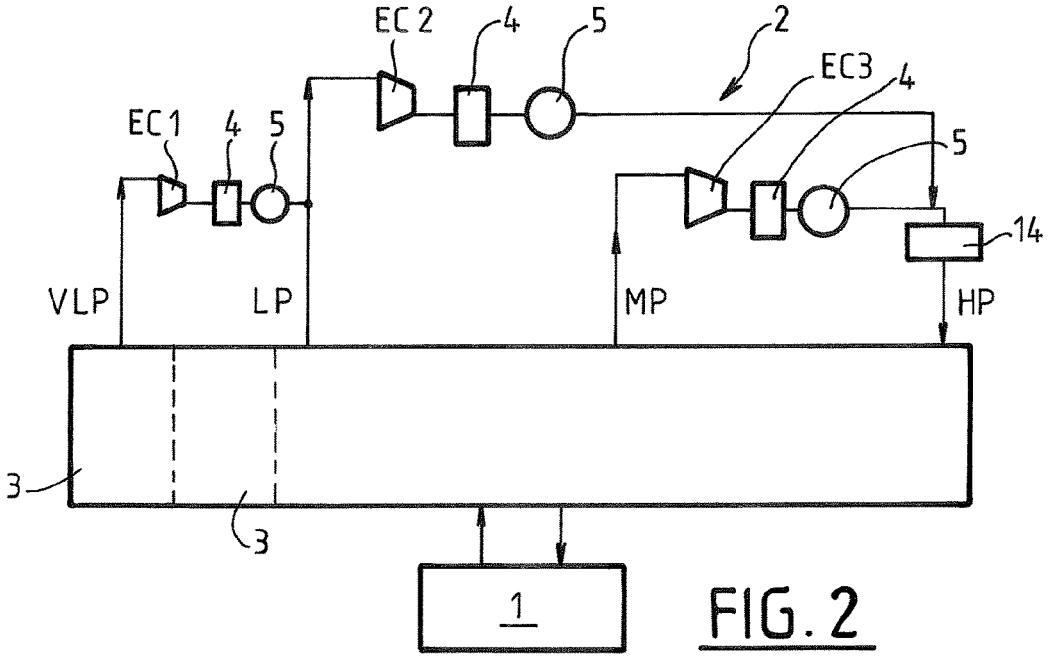
FIG. 2 shows a partial schematic view illustrating the structure and functioning of a first example embodiment according to the invention.

FIG. 2 illustrates a first possible example embodiment according to the invention. As can be seen in FIG. 2, the single common compression station 2 comprises a plurality of compression machines EC1, EC2, EC3 defining several pressure levels VLP, LP, MP, HP, HP1, HP2 for the working fluid.

At the inlet of the compression station 2, the fluid issuing from one or more cold boxes 3 arrives at a so-called "very low" pressure (VLP). This very low level pressure depends on the application 1 and this very low pressure level may not be present for some applications (that is to say the first pressure level in the compression station is said to be "low", that is to say included in the range mentioned below). A first compression machine EC1 provides a pressure rise in the working fluid to a so-called "low" pressure LP that is higher than the very low pressure VLP. At the discharge from this first compression machine EC1, the fluid may be de-oiled in an oil-removal member 4 and then cooled in a heat exchanger 5. The discharge of the first compression machine EC1 is then connected to the inlet of a second compression machine EC2, which compresses the fluid from the basic pressure LP to a high pressure HP. The inlet of this second compression machine EC2 also receives the fluid at this low pressure level LP issuing from the cold boxes 3. As before, at the discharge from this second compression machine EC2, the fluid may be de-oiled in an oil-removal member 4 and then cooled in a heat exchanger 5. Before returning to the cold boxes 3, the fluid may undergo a last more selective oil removal in a final oil-removal system 14. A third compression machine EC3 is disposed in the compression station 2. This third compression machine EC3 is supplied at its inlet with fluid from the boxes 3 at a so-called "medium" pressure MP intermediate between the low LP and high HP levels. This third compression machine EC3 also defines at its fluid outlet a "high" pressure level HP for the working fluid. At the discharge from this second compression machine EC2, the fluid may be de-oiled in an oil-removal member 4 and then cooled in a heat exchanger 5. The high-pressure working fluid is injected upstream of the final oil-removal system 14 (a pipe is connected to the outlet of the second compression machine EC2.

This solution therefore combines several lubricated-screw compression machines between the low pressure LP and high pressure HP and in addition has a compression level between the intermediate pressure MP and the same high pressure HP.

This configuration has the advantage of reducing the size of the primary oil-management systems 4 (oil-removal system 4 before the final oil removal 14) in particular on the part of the cycle between the low pressure LP and the high pressure HP. This architecture also makes it possible simultaneously to preserve flexibility on the variations in flow rate and pressure possible in this part of the circuit (in particular between the medium pressure MP and the high pressure HP).

On the other hand this solution is less flexible with regard to the possibility of varying the flow rate of working fluid in the low pressure LP since the combined compression machines are interdependent and the fluctuations are more difficult to control.

Each of the compression stages implemented by a compression machine may of course be replaced by two (or more) compressors disposed in parallel. This is because, depending on the flow rates of working fluid necessary, each compression level may be divided into several compressors disposed in parallel. In this case, the primary oil management (oil removal) and cooling systems may be common to several compressors or be dedicated to each one.

According to the very low pressure level VLP and the compression ratio of the first compression machine EC1, the outlet of the first compression machine EC1 may also be connected to the inlet of the third compression machine EC3 at a so-called "medium" pressure level MP. The rest of the architecture remaining similar.

Figure 3:
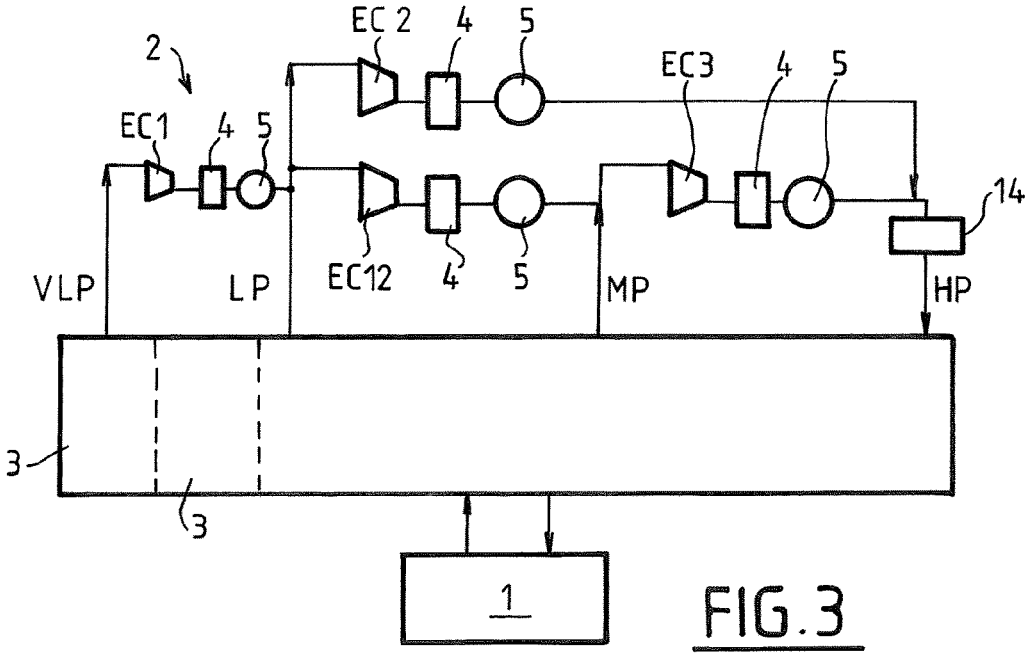
FIG. 3 shows a partial schematic view illustrating the structure and functioning of a second example embodiment according to the invention.

The variant in FIG. 3 is distinguished from that in FIG. 1 only in that the installation comprises a fourth compression machine EC12 disposed in parallel with the second compression machine EC2. In the same way as for the second compression machine EC2, the fluid inlet of the fourth compression machine EC12 is connected both to the outlet of the first compression machine EC1 and to a fluid inlet at this low pressure from the cold boxes 3. The outlet of the fourth compression machine EC12 is for its part connected to the inlet of the third compression machine EC3 (the inlet of the third compression EC3 also receives fluid at the medium pressure MP from the cold boxes).

As before, the second EC2 and fourth EC12 compression machines in parallel may each have at their outlet a dedicated oil-removal system 4 and a dedicated heat exchanger 5. In a variant these oil-removal systems 4 and heat exchanger 5 may be common and therefore shared.

As before, according to the working fluid flow rates required, each compression level may be divided into several machines (compressors) disposed in parallel.

As before also, this solution combines several compressors between the low pressure LP and the high pressure HP and in addition provides a compression level between the intermediate pressure MP and the same high pressure HP.

In the case of FIG. 3 however, part of the flow of working fluid at low pressure LP passes through compression machines EC12 that compress the fluid only to the intermediate pressure MP.

The latter compression machines EC12 may be equipped with speed variators in order to react to variations in low-pressure fluid flow rate. The recirculation of fluid between the low pressures LP and medium pressure MP is also possible in order to react to variations in load.

The compressor or compressors EC2 combined between the low pressure LP and the high pressure HP may function with a constant flow rate and independently of the fluctuations in load (application 1) and working cycle. The fluctuations in flow rates and pressures are absorbed by the group of compressors EC1, EC3, EC12 between the very low input pressure VLP as far as the higher levels (LP-> MP->HP).

Figure 4:
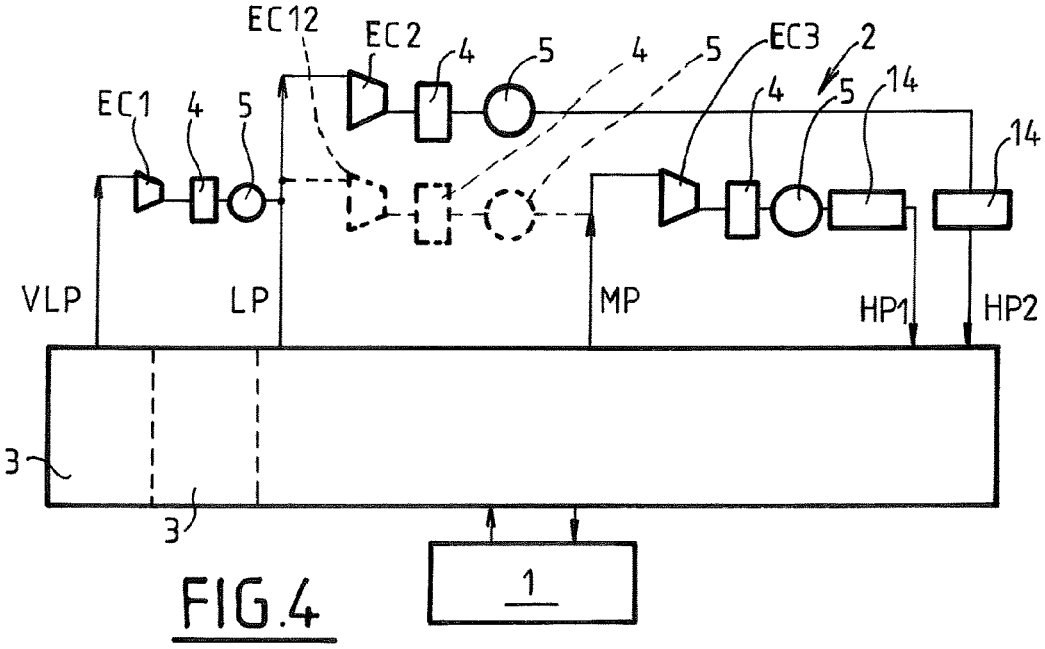
FIG. 4 shows a partial schematic view illustrating the structure and functioning of a third example embodiment according to the invention.

The variant in FIG. 4 is distinguished from that in FIG. 3 only in that the outlets of the third compression machine EC3 and second compression machine EC2 are connected to at least one cold box 3 at separate locations defining respective separate high pressure levels HP1, HP2 for the fluid. In addition, in FIG. 4, the conduit comprising the fourth compression machine EC12 and the downstream members thereof (oil-removal unit 4 and heat exchanger 5) has been shown in broken lines (in order better to show the optional character thereof).

In this configuration of FIG. 4, each high-pressure outlet HP1, HP2 of the third EC3 and second EC2 compression machines comprises, downstream of a respective heat exchanger 5, a respective final oil-removal member 14. Two final oil-removal systems 14 are in fact essential because of the difference in pressure between the two lines.

As before, part of the flow of fluid at low pressure LP is compressed directly to a high pressure HP2. In this configuration in FIG. 4, this high pressure HP2 is independent of the high pressure HP1 obtained at the outlet of the compressors that compress between the medium pressure MP and the high pressure HP1.

This architecture also makes it possible to optimise the sizes and efficiencies of the various types of compressor of the various compression stages.

The variations in flow rate and pressure of the fluid on the circuits resulting respectively in the two high pressure levels HP1 and HP2 can therefore also be managed more independently.

The circuit comprising a compression stage between the medium pressure MP and high pressure HP1 in general supplies the majority of the pressure-reduction turbines of the cycle of the cold boxes 3 that are the refrigeration source of the system. A variation of this cycle therefore permits a direct variation of the refrigeration capacity of the refrigerators/liquefiers L/R.

On the other hand, the high-pressure fluid circuit HP2 issuing from the second compression machine EC2 may be used preferentially for supplying an application 1 and/or an expansion circuit of a cooling of the Joule-Thompson type at the cold end of the cycle.

The invention may in particular apply to any refrigeration/liquefaction unit with a high liquefaction or refrigeration capacity using helium or a rare gas.

By way of non-limitative example (circuit with three compression stages but defining four pressure levels), the respective pressure levels very low VLP, low LP, medium MP and high HP of the compression stages as well as the corresponding compression ratios and flow rates of the working gas may be included in the following ranges.

| Compression stage | aspiration pressure of the corresponding compression machine (in bar) | flow rates in the compression machine (in g/s) | compression ratios of the compression stage (without unit) |
|---|---|---|---|
| VLP | 0.05 -> 1.0 | 10 -> 500 | 2 -> 15 |
| LP | 1.0 -> 2.5 | 500 -> 2000 | 2 -> 5 |
| HP | 3 -> 6 | 800 -> 4500 | 2 -> 5 |

The architectures of the compression stations in the examples illustrated may advantageously apply also to an installation using a single liquefier/refrigerator (rather than several in parallel).

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. An installation for a refrigeration of an application, comprising several refrigerators/liquefiers disposed in parallel, the refrigerator(s)/liquefier(s) using a working gas, the working gas having a mean total molar mass of less than 10 g/mol, wherein:

each refrigerator/liquefier comprises a compression station that compresses the working gas and a cold box that cools the working gas at an output from the compression station, the working gas cooled by each of the respective cold boxes of the refrigerators/liquefiers being adapted and configured to cool to the application through heat exchange with the application;

the refrigerators/liquefiers share a single compression station compressing the working gas for each of the respective separate cold boxes of the refrigerators/liquefiers;

the single compression station comprising only a plurality of lubricated-screw compressors and oil removal systems adapted and configured to remove oil from the working fluid output from the plurality of lubricated screw compressors, the plurality of lubricated screw compressors define several increasing pressure levels for the working fluid;

a passage from one pressure of the several increasing pressure levels to a higher one of the several increasing pressures levels is achieved via one or more of the lubricated screw compressors in series or via several of the lubricated screw compressors disposed in parallel;

at least two of the lubricated screw compressors define at least two increasing pressure levels above a pressure level of the working fluid at an inlet of the compression station;

a first and a second main lubricated screw compressors of the plurality of lubricated screw compressors are disposed in series without any other of the lubricated screw compressors in series between the first and the second main lubricated screw compressors;

the first and second main lubricated screw compressors define at respective fluid outlets, a low pressure level and a high pressure level, respectively;

a secondary lubricated screw compressor of the plurality of lubricated screw compressors receives, at an inlet thereof, working fluid issuing from the cold boxes at a medium pressure level that is intermediate the low and high pressure levels;

the secondary lubricated screw compressor defines, at a fluid outlet of the second lubricated screw compressor, a pressure that is at the high pressure level; and the medium pressure level is higher than a pressure level at inlets of the first and second main lubricated screw compressors.

2. The installation of claim 1, wherein the fluid outlets of the secondary lubricated screw compressor and of the second main lubricated screw compressor are connected to a common conduit, so that a pressure of the working gas at the outlets of the secondary lubricated screw compressor and the second main lubricated screw compressor are at a same high pressure level.

3. The installation of claim 1, wherein the fluid outlets of the secondary lubricated screw compressor and of the second main lubricated screw compressor are connected to at least one cold box at separate locations so that a pressure of the working gas at the outlets of the secondary lubricated screw compressor and the second main lubricated screw compressor are at respective different high pressure levels for the fluid.

4. The installation of claim 1, wherein the high pressure level at the fluid outlet of the secondary lubricated screw compressor is higher than the pressure level at the inlets of the first and second lubricated screw compressors.

5. The installation of claim 1, wherein a fluid pressure level at the fluid outlet of first main lubricated screw compressor is at the low level and corresponds to the fluid pressure level at the inlet of the second main compression machines, the medium pressure level being intermediate between the low pressure level and the high pressure level.

6. The installation of claim 1, wherein the working fluid comprises helium.

7. The installation of claim 1, wherein the working fluid essentially consists of helium.

* * * * *